US009127826B2

(12) United States Patent
Boyer et al.

(10) Patent No.: US 9,127,826 B2
(45) Date of Patent: Sep. 8, 2015

(54) INDIRECT LIGHTING LUMINAIRE

(71) Applicant: LSI Industries, Inc., Cincinnati, OH (US)

(72) Inventors: John D. Boyer, Lebanon, OH (US); Daniel Hutchens, Cold Spring, KY (US); Travis Montgomery Wright, Cincinnati, OH (US)

(73) Assignee: LSI Industries, Inc., Cincinnati, OH (US)

( * ) Notice: Subject to any disclaimer, the term of this patent is extended or adjusted under 35 U.S.C. 154(b) by 194 days.

(21) Appl. No.: 13/803,487

(22) Filed: Mar. 14, 2013

(65) Prior Publication Data

US 2014/0268715 A1 Sep. 18, 2014

(51) Int. Cl.

| | |
|---|---|
| ***F21V 7/09*** | (2006.01) |
| ***F21V 7/00*** | (2006.01) |
| ***F21S 8/02*** | (2006.01) |
| ***F21V 15/015*** | (2006.01) |
| ***F21V 23/00*** | (2015.01) |
| *F21Y 101/02* | (2006.01) |
| *F21Y 113/00* | (2006.01) |

(52) U.S. Cl.

CPC ..... *F21V 7/0008* (2013.01); *F21S 8/026* (2013.01); *F21V 15/015* (2013.01); *F21V 23/002* (2013.01); *F21Y 2101/02* (2013.01); *F21Y 2113/00* (2013.01)

(58) Field of Classification Search

CPC ..... B60Q 3/00; B60Q 3/02; B60Q 3/0266; F21S 8/02; F21S 8/06; F21S 8/08; F21V 7/0008; F21V 7/0066; F21V 13/10; F21V 7/09; F21Y 2101/02; F21Y 2113/005; F21Y 2103/003; G09F 13/14; G09F 2013/145; G02F 1/133606

USPC ..... 362/147, 148, 364–366, 217.1, 362/217.11–217.17, 221–225, 217.01, 362/217.02, 217.05, 217.07, 235, 249.01, 362/249.02

See application file for complete search history.

(56) References Cited

U.S. PATENT DOCUMENTS

| | | | | |
|---|---|---|---|---|
| 3,560,729 | A * | 2/1971 | Liberman | 362/294 |
| 3,777,135 | A | 12/1973 | Rees | |
| 4,435,744 | A | 3/1984 | Russo | |
| 4,517,631 | A | 5/1985 | Mullins | |

(Continued)

FOREIGN PATENT DOCUMENTS

| | | |
|---|---|---|
| KR | 100934683 | 12/2009 |
| TW | 536359 | 6/2003 |

(Continued)

OTHER PUBLICATIONS

Invitation to Pay Additional Fees and Where Applicable, Protest Fee dated Jul. 2, 2014 from Corresponding PCT Application No. PCT/US2014/018248.

(Continued)

*Primary Examiner* — Hargobind S Sawhney

(74) *Attorney, Agent, or Firm* — McDermott Will & Emery LLP

(57) ABSTRACT

A luminaire comprising a reflector having first and second outer edges and defining a downwardly open recess, the reflector defining a downwardly depending peak dividing the downwardly open recess into two troughs; a light source located at each of the first and second outer edges and configured to emit light into the downwardly open recess.

20 Claims, 8 Drawing Sheets

(56) References Cited

U.S. PATENT DOCUMENTS

| | | | | |
|---|---|---|---|---|
| 4,748,543 | A * | 5/1988 | Swarens | 362/147 |
| 4,928,209 | A * | 5/1990 | Rodin | 362/221 |
| 5,530,628 | A * | 6/1996 | Ngai | 362/33 |
| D386,804 | S | 11/1997 | Engel | |
| 5,709,460 | A | 1/1998 | Lester | |
| D407,473 | S | 3/1999 | Wimbock | |
| 5,988,829 | A * | 11/1999 | Holder | 362/223 |
| 5,988,836 | A | 11/1999 | Swarens | |
| 6,523,974 | B2 | 2/2003 | Engel | |
| 6,561,678 | B2 | 5/2003 | Loughrey | |
| 6,739,734 | B1 * | 5/2004 | Hulgan | 362/243 |
| 6,758,580 | B1 | 7/2004 | Verfuerth | |
| 6,789,914 | B1 * | 9/2004 | Brown et al. | 362/147 |
| 7,090,375 | B2 * | 8/2006 | Kuisma | 362/225 |
| D593,246 | S | 5/2009 | Fowler et al. | |
| 7,588,345 | B1 * | 9/2009 | Davis et al. | 362/223 |
| 7,591,578 | B2 | 9/2009 | Chang | |
| 7,607,794 | B1 * | 10/2009 | Thompson | 362/147 |
| D605,342 | S | 12/2009 | Chung et al. | |
| D608,490 | S | 1/2010 | Chung et al. | |
| 7,703,945 | B2 | 4/2010 | Leung et al. | |
| D617,487 | S | 6/2010 | Fowler et al. | |
| 7,794,114 | B2 | 9/2010 | Medendorp, Jr. | |
| 7,874,697 | B2 * | 1/2011 | Biebel et al. | 362/225 |
| D633,247 | S | 2/2011 | Kong et al. | |
| 7,976,187 | B2 | 7/2011 | Villard | |
| 8,038,314 | B2 | 10/2011 | Ladewig | |
| D653,376 | S | 1/2012 | Kong et al. | |
| 8,100,551 | B2 * | 1/2012 | Mayfield et al. | 362/223 |
| 8,118,450 | B2 | 2/2012 | Villard | |
| D661,833 | S | 6/2012 | Imajo | |
| D664,699 | S | 7/2012 | Nakahira et al. | |
| 8,220,955 | B2 | 7/2012 | Kwak et al. | |
| D665,119 | S | 8/2012 | Bryant | |
| D672,079 | S | 12/2012 | Kong et al. | |
| D673,711 | S | 1/2013 | Pickard et al. | |
| D677,820 | S | 3/2013 | Mayfield et al. | |
| D677,825 | S | 3/2013 | Collins | |
| 8,425,101 | B2 * | 4/2013 | Boonekamp | 362/609 |
| D681,872 | S | 5/2013 | Kong et al. | |
| D692,610 | S | 10/2013 | Sitarski et al. | |
| 8,579,473 | B2 | 11/2013 | Holten et al. | |
| D696,449 | S | 12/2013 | Boyer et al. | |
| D698,969 | S | 2/2014 | Johns et al. | |
| D698,975 | S | 2/2014 | Blessitt et al. | |
| 2003/0063461 | A1 * | 4/2003 | Tant | 362/147 |
| 2007/0076416 | A1 | 4/2007 | Leonhardt et al. | |
| 2007/0127244 | A1 | 6/2007 | Cunius | |
| 2007/0263379 | A1 | 11/2007 | Dowling | |
| 2008/0278943 | A1 | 11/2008 | Van Der Poel | |
| 2009/0034252 | A1 | 2/2009 | Engel | |
| 2010/0290208 | A1 | 11/2010 | Pickard | |
| 2011/0096544 | A1 | 4/2011 | Nakamura | |
| 2011/0122618 | A1 | 5/2011 | Gantenbrink | |
| 2011/0176306 | A1 | 7/2011 | Kim et al. | |
| 2012/0002411 | A1 | 1/2012 | Ladewig | |
| 2012/0019137 | A1 | 1/2012 | Safarikas et al. | |
| 2012/0051041 | A1 | 3/2012 | Edmond et al. | |
| 2012/0140461 | A1 | 6/2012 | Pickard | |
| 2012/0212956 | A1 | 8/2012 | Chen | |
| 2013/0194820 | A1 | 8/2013 | Pickard et al. | |
| 2013/0208457 | A1 | 8/2013 | Durkee et al. | |
| 2013/0286637 | A1 | 10/2013 | Lay et al. | |
| 2013/0294053 | A1 | 11/2013 | Marquardt et al. | |
| 2013/0294059 | A1 * | 11/2013 | Galluccio et al. | 362/218 |
| 2014/0036494 | A1 | 2/2014 | Holten et al. | |
| 2014/0092594 | A1 * | 4/2014 | Radl et al. | 362/235 |

FOREIGN PATENT DOCUMENTS

| | | |
|---|---|---|
| TW | D133227 | 2/2010 |
| TW | D148777 | 8/2012 |

OTHER PUBLICATIONS

High Efficiency, Expansive Cavity Recessed ASC Datasheet, LSI Industries, Inc., 2 pages (2012).
LED Peak Efficiency Recessed Direct/Indirect (PEC) Data Sheet, LSI Industries, Inc., 1 page (2012).
Peak Efficiency (1×4, 2×4)—Recessed Direct/Indirect Datasheet, LSI Industries, Inc., 2 pages (2012).
Peak Efficiency (2×2)—Recessed Direct/Indirect Datasheet, LSI Industries, Inc., 2 pages (2012).
Surface Peak Efficiency (2×2)—Direct/Indirect Datasheet, LSI Industries, Inc., 1 page (2012).
Surface Peak Efficiency (1×4, 2×4)—Direct/Indirect Datasheet, LSI Industries, Inc., 2 page (2012).
Recessed Direct/Indirect—Side Distribution (1×4, 2×4) Datasheet, LSI Industries, Inc., 2 page (2012).
Recessed Direct/Indirect—Side Distribution (2×2) Datasheet, LSI Industries, Inc., 2 page (2012).
Search Report dated Mar. 19, 2014 from Corresponding Taiwan Patent Application No. 102306096.

* cited by examiner

INDIRECT LIGHTING LUMINAIRE

FIELD OF THE DISCLOSURE

The present disclosure relates generally to a luminaire and, more particularly, to a luminaire for hiding one or more light sources from view and redirecting the light from the one or more light sources to illuminate a target area. The disclosure finds particularly useful application when the luminaire employs multiple light sources including, in one embodiment, one or more light emitting diodes ("LEDs"). The disclosure finds particularly useful application as a troffer luminaire for installation in, for example, a drop ceiling.

BACKGROUND OF THE DISCLOSURE

Uncontrolled light can be wasted in lighting areas around the target area to be lighted and contributes to unnecessarily high energy costs and more robust power equipment than necessary. When the light source is one or more LEDs (or other small light sources), it is known to distribute the emitted light by one or more reflectors associated with one or more light sources.

It has been found that the human eye may find looking directly at an illuminated light source (such as an LED) may be unpleasant or unsightly. It has further been found that routing and accessing power facilities such as a driver and electrical wiring to a light source, especially a light source hidden from view, can prevent a luminaire constructed for ready installation that makes efficient use of space and energy and does not cause disruptions in the redirection of light from light sources.

SUMMARY OF THE DISCLOSURE

The present disclosure relates to a luminaire configured to overcome these and other prior deficiencies and efficiently distribute light emitted from one or more light sources in a luminaire in which the one or more light sources are hidden from sight such that all light visible to the human eye has been redirected (i.e. "indirect light") by, for example, one or more reflectors.

In one embodiment, the present disclosure relates to a luminaire comprising a reflector dividing the luminaire into a top side and a bottom side, the reflector having a top surface adjacent the luminaire top side and a bottom surface adjacent the bottom side, the reflector further having first and second opposing ends; a light source located on the luminaire bottom side; a driver located on the luminaire top side for delivering power to the light source; an inner end cap located at the first end of the reflector; an outer end cap associated with the inner end cap, the inner and outer end caps defining a channel therebetween; wiring run from the driver through the channel to the light source. The inner end cap and outer end cap can be contiguous. The channel can be defined by a depression formed in one of the inner end cap and outer end cap. The channel can also be defined by a depression formed in each of the inner end cap and outer end cap. The channel can comprise a vertically oriented channel and a horizontally oriented channel. The reflector can define two inverted troughs, each having an inner side and an outer side, the inner sides of the inverted troughs meeting at a vertical centerline of the luminaire and defining a downwardly depending peak and the driver being located in the luminaire top side of the downwardly depending peak; the inner end cap closing off a first end of the inverted troughs; the light source located at the outer side of one of the inverted troughs; and the channel extending from the luminaire top side of the downwardly depending peak to a position adjacent to the light source.

In another embodiment, the present disclosure relates a luminaire comprising a reflector defining two inverted troughs, each having an inner side and an outer side, the inner sides of the inverted troughs meeting at a vertical centerline of the luminaire and defining a downwardly depending peak; the inverted troughs jointly defining a downwardly open recess of the luminaire; a first end cap closing off a first end of the inverted troughs and a second end cap closing off a second end of the inverted troughs, wherein the second end of the inverted troughs is opposite the first end of the inverted troughs; a light source located at the outer side of each inverted trough and configured to emit light into the downwardly open recess; and a lip extending inward and upward from adjacent to each light source to a distal end. Each light source can be one or more LEDs. Each light source can comprise one or more LEDs facing inward and upward at an angle from horizontal. The lip distal end can lie in a horizontal plane encompassing the light sources. The lip can be an integral extension of the reflector. Each light source can comprise one or more LEDs located on a LED mount comprising a LED mount base and a lower leg, the lip comprising a lower grasping leg extending from the reflector and an upper grasping leg extending from the lower grasping leg, and the LED mount base lower leg is held between the upper and lower grasping legs. The first and second end caps and the lip can collectively define a light aperture, and the light source can be located so that light emitted from the light source passes through the light aperture. The first and second end caps and the lip can collectively define a light aperture, and the light source can be located so that light emitted from the light source passes through the light aperture, the light aperture defining a horizontal plane that encompasses the downwardly depending peak. The first and second end caps and the lip can collectively define a light aperture, and the light source can be located so that light emitted from the light source passes through the light aperture and the light aperture can define a horizontal plane that does not encompass the downwardly depending peak. The downwardly depending peak can define a V-shaped protrusion culminating in a vertex. The reflector can be symmetrical about the vertical luminaire centerline. The luminaire can further comprise a top plate extending from the top surface of one inverted trough to the other inverted trough, covering the top surface of the downwardly depending peak to create an enclosed space. Each reflector trough can define a straight first reflecting leg, a second straight reflecting leg extending at an angle to the first reflecting leg, a curved third reflecting leg extending from the second reflecting leg and a fourth reflecting leg extending from the third reflecting leg; the fourth reflecting legs of the two reflector troughs meeting at the luminaire vertical centerline.

In yet another embodiment, the present disclosure relates to a luminaire comprising a reflector having first and second outer edges and defining a downwardly open recess; the reflector defining a downwardly depending peak dividing the downwardly open recess into two troughs; a light source located at each of the first and second outer edges and configured to emit light into the downwardly open recess. The light source can comprise one or more LEDs. The luminaire can further comprise a first end cap closing off a first end of the inverted troughs and a second end cap closing off a second end of the inverted troughs, the second end of the inverted troughs is opposite the first end of the inverted troughs. The downwardly depending peak can culminate in a vertex located at a vertical centerline of the luminaire. Each light source can comprise one or more LEDs facing inward and upward at an angle from horizontal. The luminaire can further comprise a lip extending inward and upward from adjacent to the light source to a distal end. The lip distal end can lie in a horizontal plane encompassing the light sources. The luminaire can comprise a lip extending inward and upward from adjacent to the light source to a distal end, the first and second end caps and the lip collectively defining a light aperture, and the light source located so that light emitted from the light source passes through the light aperture, the light aperture defining a horizontal plane. The horizontal plane can encompass the downwardly depending peak. Alternatively, the horizontal plane need not encompassing the downwardly depending peak. The downwardly depending peak can define a V-shaped protrusion culminating in a vertex.

DETAILED DESCRIPTION OF THE PREFERRED EMBODIMENTS

Figure 1A:
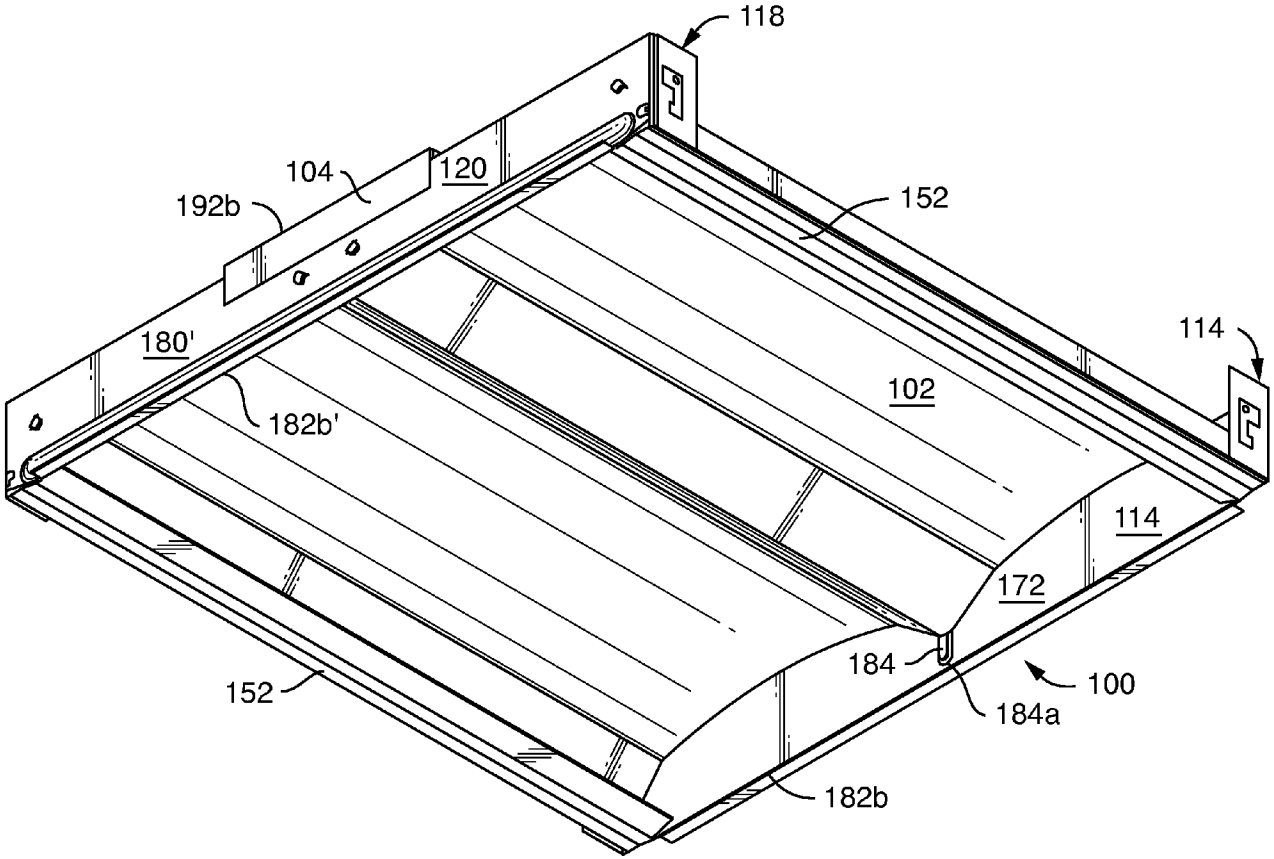
FIG. 1A is a bottom-side perspective view of an exemplary luminaire according to the instant disclosure.
Figure 1B:
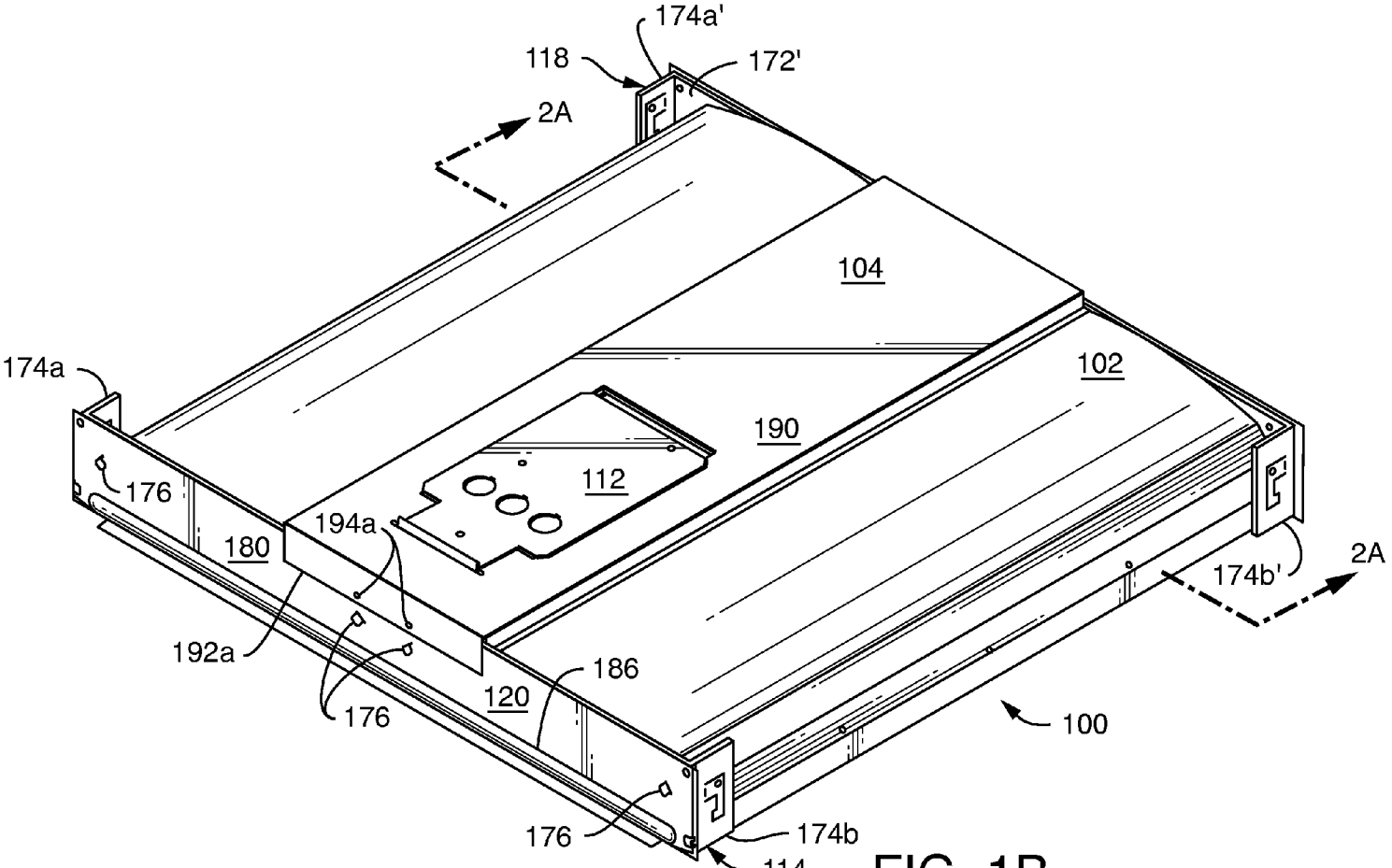
FIG. 1B is a top-side perspective view of the luminaire depicted in FIG. 1A.
Figure 1C:
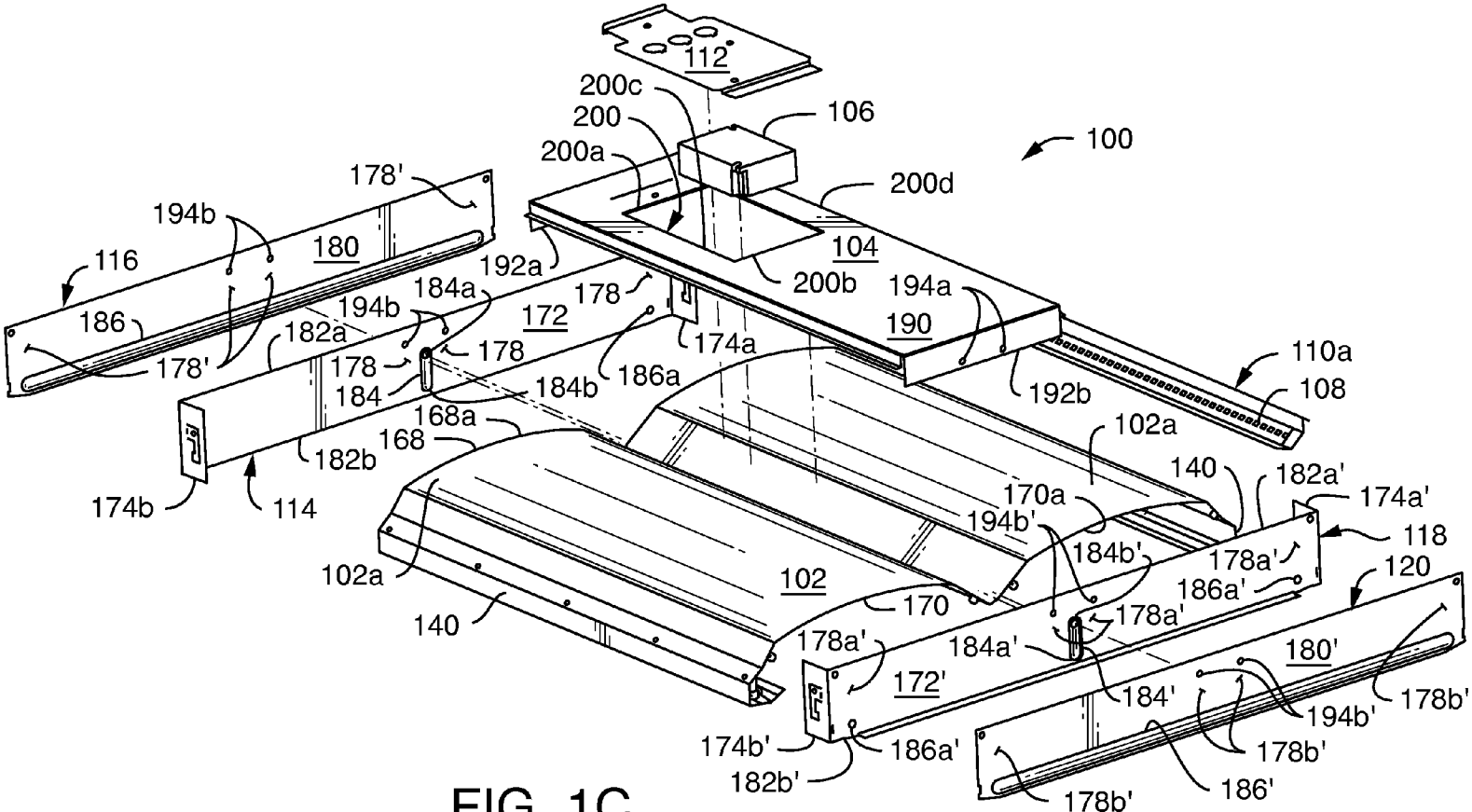
FIG. 1C is an exploded view of the luminaire depicted in FIG. 1A.

FIGS. 1A-1C depict a luminaire 100 configured as a troffer for installation in a drop ceiling (not shown) or the like. However, the principals of this disclosure can be applied to any type of luminaire for installation in other environments. The luminaire 100 of FIGS. 1A-1C comprises a reflector 102, a top plate 104, a driver 106 for providing power to a plurality of LEDs 108 mounted on LED mounts 110*a* and 110*b*, an access plate 112, a first inside end cap 114, a first outside end cap 116, a second inside end cap 118 and a second outside end cap 120. Although luminaire 100 is depicted with LEDs 108, any other light source could be employed with the principals of this disclosure. Use of the term "LED" as part of any element of the luminaire 100 described as part of this exemplary embodiment shall not limit application of that element to other types of light sources. The use of the term LED herein is meant to incorporate any and all light emitting diodes and any other light sources known to date or hereinafter created.

Figure 2A:
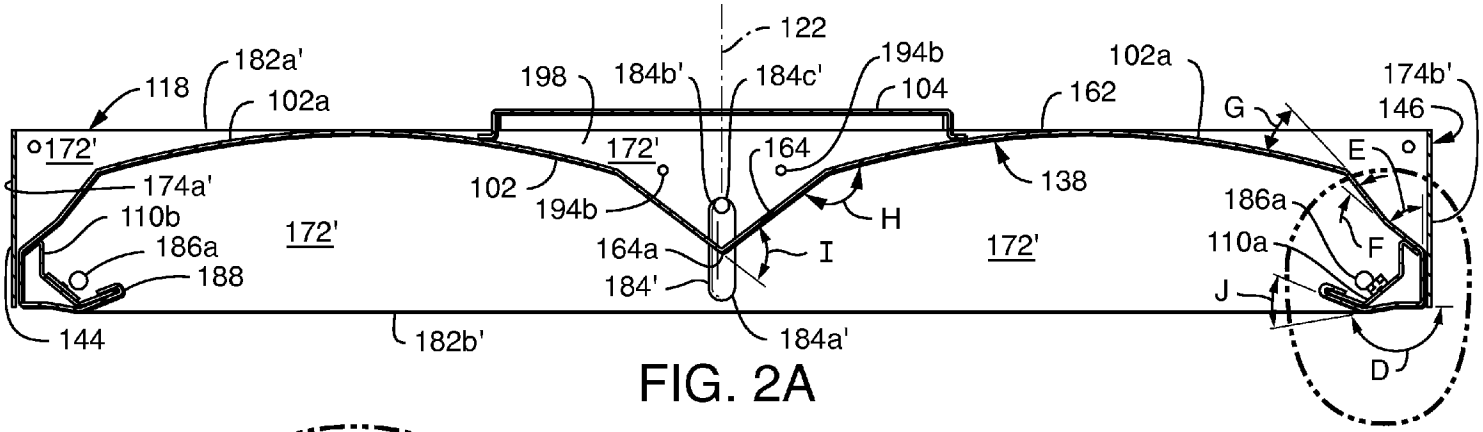
FIG. 2A depicts a cross-sectional view of the luminaire depicted in FIG. 1A, taken through line 2A-2A in FIG. 1B.
Figure 2C:
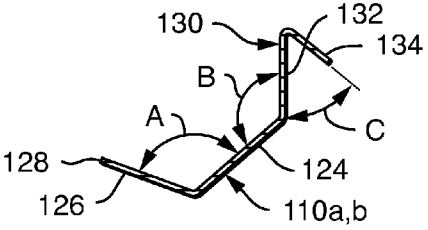
FIG. 2C depicts a LED mount shown in FIGS. 2A and 2B.

FIG. 2A depicts a cross-section of the luminaire 100 taken through lines 2A-2A in FIG. 1B. This cross-section shows the LED mounts 110*a*, 110*b* on which arrays of LED 108 are mounted and their incorporation into the reflector 102. The luminaire 100 is symmetrical about a vertical centerline 122. As best depicted in FIG. 2C, the LED mounts 110*a,b* have a LED mount base 124 onto which the array of LEDs 108 can be mounted. The LED mount base 124 is depicted as flat, but can be otherwise as needed to facilitate mounting the LEDs 108. A lower leg 126 extends straight from the LED mount base 124 at an angle A (which can be 119° in one embodiment) to a distal end 128 and serves to secure the LED mount 110*a*, 110*b* to the reflector as will be described in more detail below. An upper leg 130 also extends from the LED mount base 124 and comprises a straight proximate upper leg portion 132 extending straight from LED mount base 124 at an angle B (which can be 131° in one embodiment) to the LED mount base 124, and a straight distal upper leg portion 134 extending from the proximate upper leg portion 132 at an angle C (which can be 51° in one embodiment) to the proximate upper leg portion 132. The legs 126, 130 and leg portions 132, 134 need not be straight, but can, instead, vary as needed to meet the objectives of incorporating the LED mounts 110*a*, 110*b* into the reflector 102 as described below.

Figure 2B:
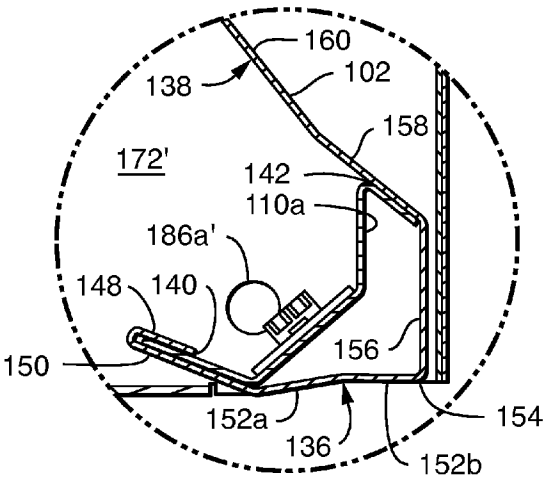
FIG. 2B is a close-up view of portion 2B identified in FIG. 2A.
Figure 2D:
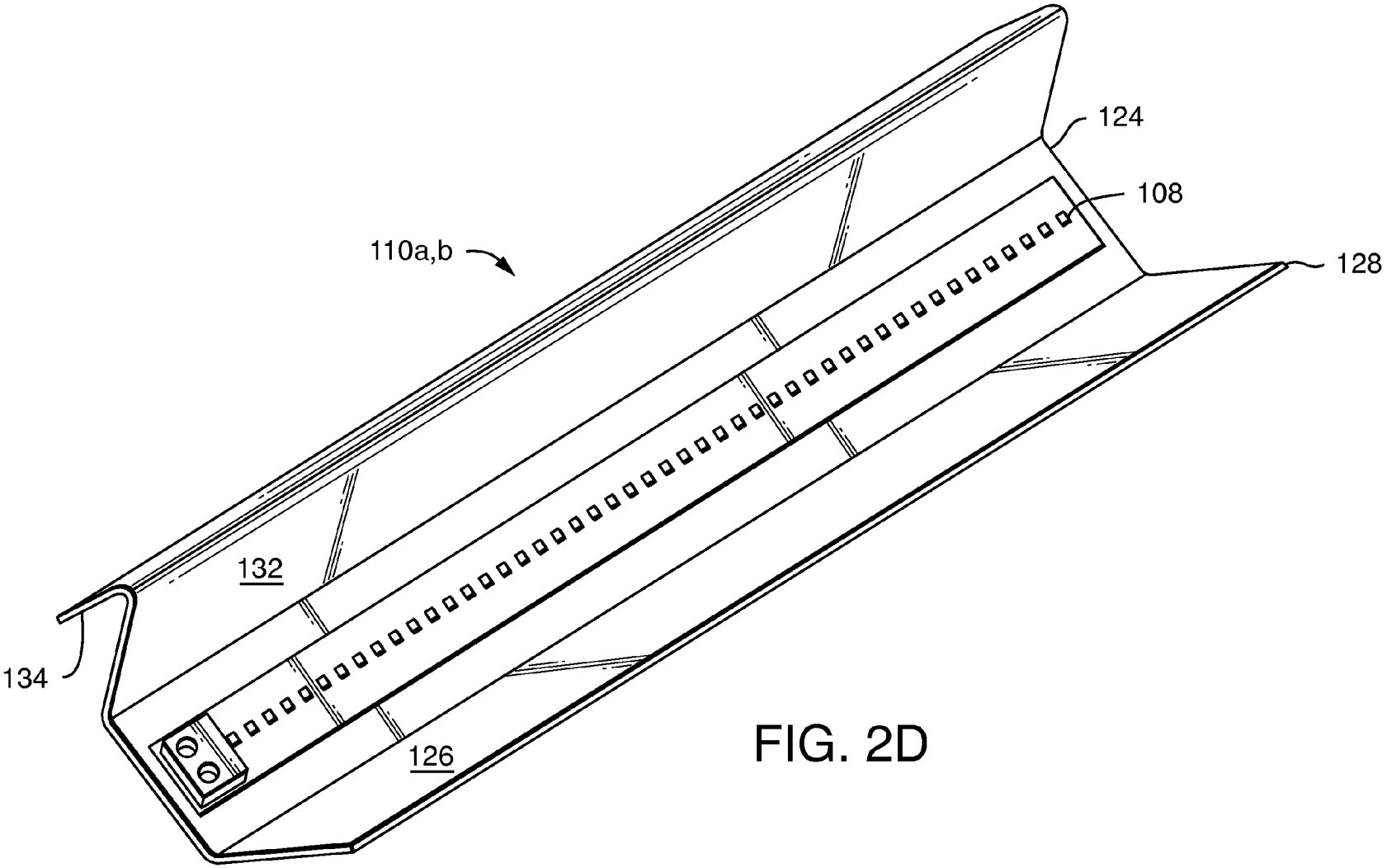
FIG. 2D is a perspective view of the LED mount shown in FIG. 2C with a circuit board comprising a plurality of LEDs.
Figure 3A:
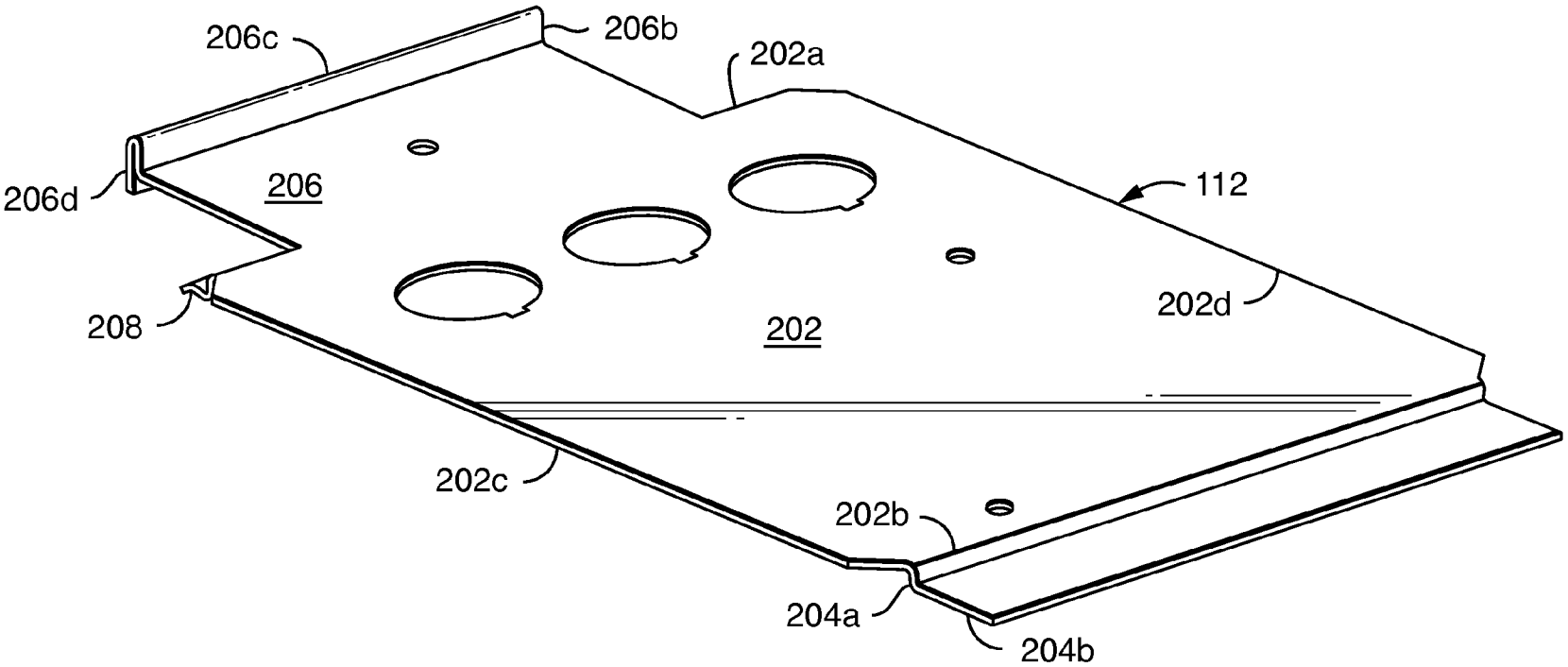
FIG. 3A is a perspective view of an access plate of the luminaire of FIG. 1A.
Figure 3B:
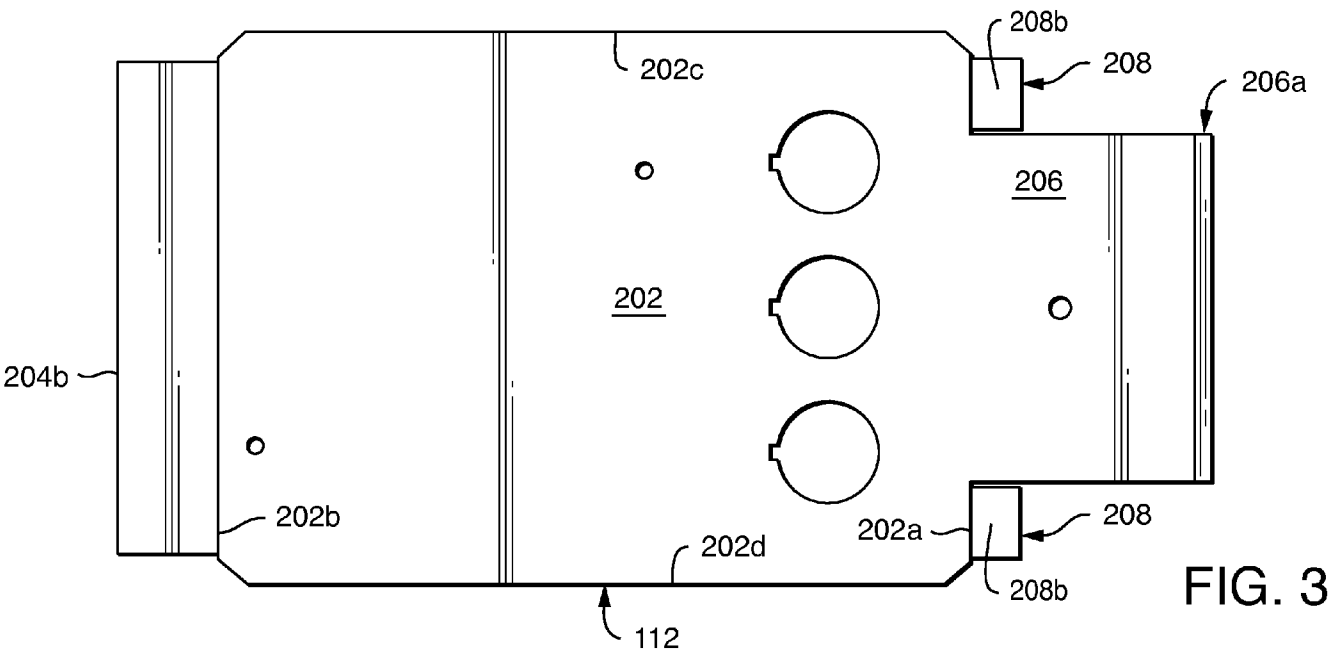
FIG. 3B is a top view of the access plate depicted in FIG. 3A.
Figure 3C:
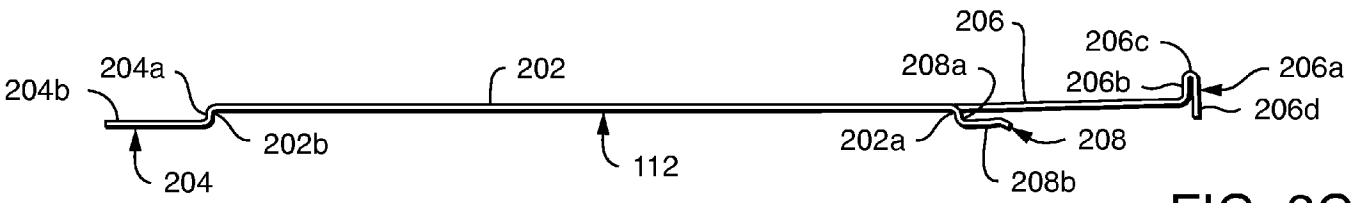
FIG. 3C is a side view of the access plate depicted in FIG. 3A.
Figure 4:
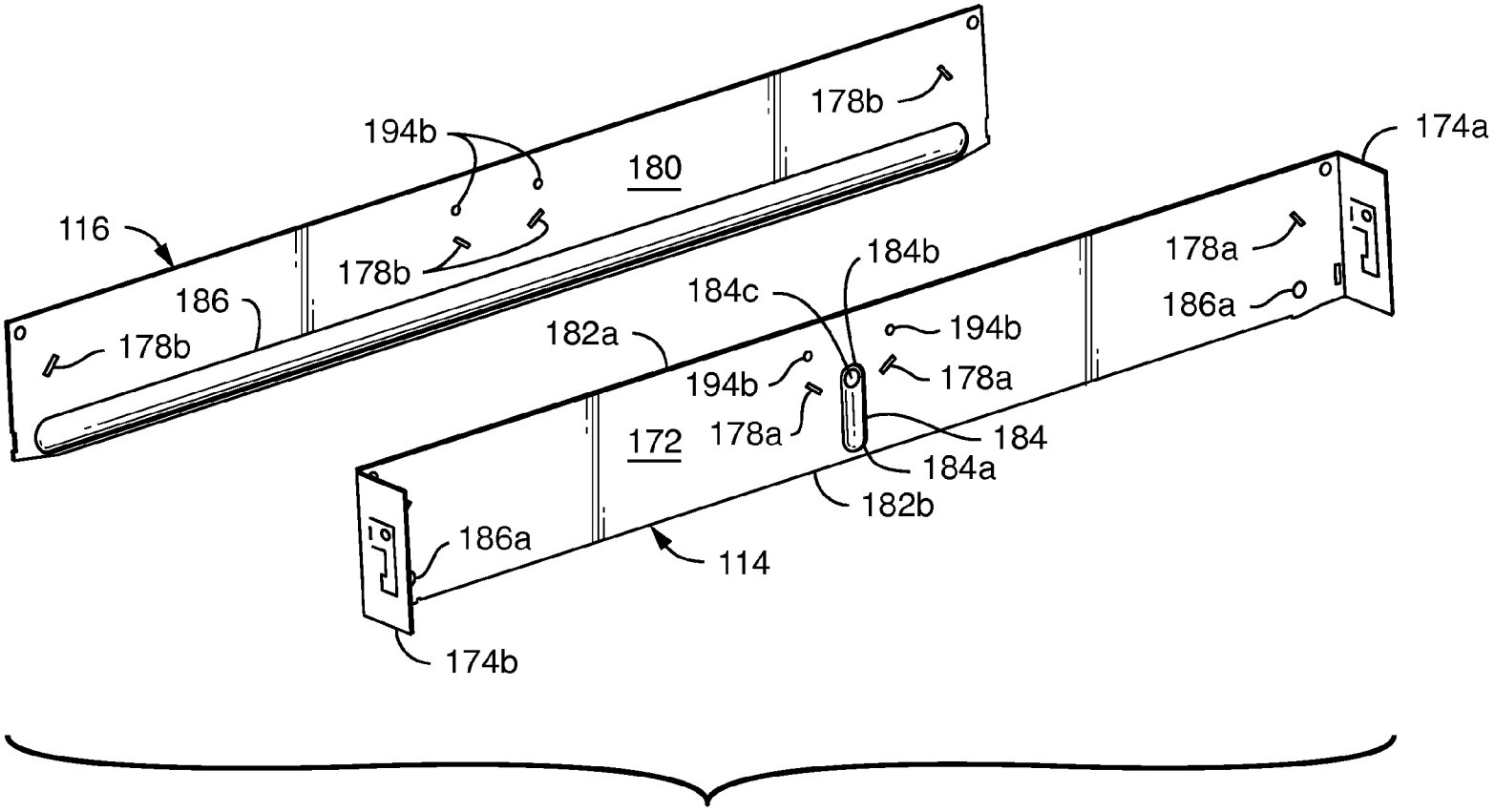
FIG. 4 is a perspective view of the first inside end cap and first outside end cap of the luminaire depicted in FIG. 1A.

The LEDs 108 of each LED mount 110*a*, 110*b* mount onto the LED mount base 124. This can be accomplished by either mounting individual LEDs 108 to the LED mount base 124, by mounting a printed circuit board (PCB) to the LED mount base 124 wherein the PCB is populated with the LEDs 108. A single PCB populated with LEDs 108 is depicted in FIG. 2D.

The reflector 102 is shown as a formed sheet symmetrical on either side of the centerline 122. The sheet may be formed sheet metal, plastic or other known material used for reflectors in luminaires and may be a single piece of material or multiple joined pieces of material. The reflector 102 may have any surface finish or coating known for providing sufficient reflection to properly direct the light emitted from the LEDs 108. The reflector 102 extends from one end 140 located proximate a left side 144 of the luminaire 100 to the other end 140 proximate a right side 146 of the luminaire 100. The reflector 102 includes two LED mount portions 136 and a light directing portion 138. The LED mount portions 136 are defined by the portions of the reflector 102 extending from an end 140 of the reflector 102 to the last point of direct contact 142 between the reflector 102 and the corresponding LED mount upper leg distal portion 134. The reflector light directing portion 138 extends between the two last points of direct contact 142.

In the reflector LED mount portions 136, the reflector end 140 is folded over and around the distal end 128 of the LED mount lower leg 126 to form an upper LED mount grasping leg 148 and a lower LED mount grasping leg 150. The upper and lower LED mount grasping legs 148, 150 together grasp and hold the LED mount 110*a* or 110*b*. In the embodiment depicted in FIG. 2B the lower LED mount grasping leg 150 follows the LED mount lower leg 126, maintaining contact there along. A face leg 152 of the reflector 102 extends from the lower LED mount grasping leg 150 to an outer edge 154 of the reflector 102 where it meets a vertical leg 156 of the reflector at, in one example, approximately a 90° angle. The face leg 152 comprises first 152*a* and second 152*b* portions. Face leg first portion 152*a* extends at angle D (which is approximately 170° in the depicted embodiment) from the face leg second portion, which is shown as oriented approximately horizontally. In this depicted embodiment, then, the face leg first portion 152*a* is oriented at 10° below horizontal. As shown, the upper and lower LED mount grasping legs 148, 150, as well as the LED mount lower leg 126, extend at angle J from the face leg first portion 152*a* (32° in one exemplary embodiment). In this configuration, the upper and lower LED mount grasping legs 148, 150, as well as the LED mount lower leg 126, extend inward and upward to define a lip that assists in hiding the LEDs 108 from view to a person in the target area to be lighted by the luminaire 100. In the depicted embodiment, the lip extends inward and upward (i.e. above horizontal) at an angel of 22°, but other angles are contemplated consistent with the objective of hiding the LEDs 108 from view and directing the light emitted by the LEDs 108 in the desired light distribution pattern from the luminaire 100.

A first inward leg 158 of the reflector 102 extends inward from the vertical leg 156 at an angle E (51° in one exemplary embodiment) and contacts the LED mount upper leg distal portion 134. The last point of direct contact 142 is defined on the first inward leg 158 in the depicted embodiment. The upper and lower LED mount grasping legs 148, 150, face leg 152, vertical leg 156 and first reflecting leg 158 form the LED mount portion 136 of the reflector 102, which defines a nest holding the LED mount 110*a* or 110*b*.

The LEDs 108 are mounted facing inward (i.e. into a downwardly open recess formed by the reflector 102) and upward from horizontal. In the depicted embodiment, by way of example, the LEDs 108 are rotated 39° counter-clockwise on the luminaire right side 146 and rotated 39° clockwise on the luminaire left side 144. Other angles are contemplated as needed to accommodate a different reflector and/or a different light distribution.

The reflector light redirecting portion 138 is configured to efficiently direct light from the LEDs 108 to the target area to be lighted under the luminaire 100. The reflector light redirecting portion 138 begins on the first reflecting leg 158 from the last point of direct contact 142 between the reflector 102 and the LED mount upper leg distal portion 134 and continues inwardly to a second reflecting leg 160, which forms an angle F therewith (13° in one exemplary embodiment). A third reflecting leg 162 initially extends from the second reflecting leg inwardly at an angle F and then forms an upwardly oriented curve (having a radius of curvature of 15.089 inches in one exemplary embodiment). Other curvatures can be employed to achieve the desired light distribution. A fourth reflecting leg 164 extends inwardly and downwardly from the third reflecting leg 162 at an angle H. In the depicted embodiment, the reflector 102 is divided into two halves by the centerline 122 and the two halves form inverted troughs which are mirror images of each other. The fourth reflecting legs 164 on each half of the reflector 102 meet at the centerline to form a depending V-shaped protrusion 166 depending downward to a vertex 164*a*. The fourth reflecting legs 164 form an angle I (74° in one exemplary embodiment). In one exemplary embodiment, the fourth reflecting legs 164 of the V-shaped protrusion 166 form an angle of approximately 106° with each other, each fourth reflecting leg 164 forming an angle of approximately 53° with the luminaire centerline 122 in this embodiment. Other angles are contemplated to vary the light distribution produced by the luminaire 100. All legs of the reflector 102 are substantially straight, except for the third reflecting leg 162, which defines the above-discussed curvatures, or variations thereof. The various legs of the reflector 102 may be separate pieces or contiguous with each other.

These reflector elements define a reflector 102 that hides the LEDs 108 from the view of persons in the target area to be lighted while at the same time directing light from the hidden LEDs 108 to that target area. This is facilitated by several features and relationships of the luminaire 100. First, the lip having a distal tip lying in a horizontal plane that encompasses (i.e. goes through) the LEDs 108. In the depicted embodiment, a portion of the lower half of the LEDs 108 lie in that horizontal plane, but other configurations are contemplated, such as the upper half or uppermost portion of the LEDs lying in that plane or even a portion of a PCB above the LEDs 108 lying in that horizontal plane. In these configurations, the lip defined by the upper and lower LED mount grasping legs 148, 150 hides the LEDs 108 from view in the target area to be lighted.

Second, the shape of the reflector 102 functions to re-direct the light emitted from the hidden LEDs 108, to the target area to be lighted. In the depicted embodiment, the reflector 102 defines a downwardly open recess having left side and right side LED mount portions 136 in which LEDs 108 are mounted in an upwardly oriented manner (i.e. the PCB is angled above horizontal as previously described), the reflector lip 148*a* (comprised, in the depicted embodiment, of upper and lower LED mount grasping legs 148, 150) extends inwardly and upwardly from the LED mount portions 136 into the downwardly open recess defined by the reflector 102, the reflector 102 further defines left side and right side inverted troughs (each comprised, in the depicted embodiment, one of the light redirecting portions 138) extending from the LED mount portions 136 upward and inward until the left side and right side inverted troughs meet at a depending protrusion (depending V-shaped protrusion 166 in the depicted embodiment) culminating in a peak (vertex 164*a* in the depicted embodiment). The reflector 102 can be symmetrical about the luminaire centerline 122 running vertically through the vertex 164*a* of the depending protrusion. The left side and right side LED mount portions 136 may define the lowermost portions of the reflector, as in the depicted embodiment.

Alternatively, the reflector 102 defines two inverted troughs arranged symmetrically on either side of, and meeting at, the vertical luminaire centerline 122 where they form the central downwardly depending peak 166. The central downwardly depending peak 166 may be the V-shaped protrusion 166 culminating in the vertex 164*a*, but other configurations are contemplated. For example, the reflector third reflecting leg 162 can continue its curvature in the downwardly depending peak 166, eliminating the straight reflector fourth reflecting leg 164. Alternatively, the reflector fourth reflecting leg 164 may define a curvature different from that of the reflector third reflector leg 162 as needed to modify the light distribution from the luminaire 100. The inverted troughs may consist of the reflector light redirecting portion 138 in one exemplary embodiment. The inverted troughs jointly define a downwardly open recess of the luminaire 100. The LEDs 108 are mounted at the outer edges of each of the inverted troughs. The LEDs 108 face generally upward. In the depicted embodiment, for example, the LEDs 108 face inward and upward at an angle of approximately 38°, as depicted in FIGS. 2A-2C. Other angles are contemplated depending on the shape of the reflector. Mounting of the LEDs 108 relative to the inverted troughs may be facilitated by the LED mount portions 136 and LED mounts 110*a*, 110*b*, extending directly or indirectly from the inverted trough. Alternatively, the reflector 102 could extend inward from the troughs to define a functional equivalent of the LED mounts 110*a*, 110*b*. In either case, the LEDs may optionally be hidden from view by the lip extending from the LEDs 108 upward at angle. In the depicted embodiment, by way of example, this is accomplished by the upper and lower LED mount grasping legs 148, 150 extending upward from horizontal at an angle 22° to define the lip. The lip preferably has a distal tip lying in a horizontal plane that encompasses (i.e. goes through) the LEDs 108. In these configurations, the lip defined by the upper and lower LED mount grasping legs 148, 150 hides the LEDs 108 from view in the target area to be lighted. The left side and right side LED mount portions 136 may define the lowermost portions of the reflector, as in the depicted embodiment.

In any embodiment of the instant disclosure, the vertex 164*a* may protrude into the luminaire 100 a sufficient distance such that the vertex 164*a* lies in a horizontal plane in which the reflector LED mount portions 136 also lie. The vertex 164*a* also protrudes into the luminaire 100 a sufficient distance such that the vertex 164*a* lies in a horizontal plane in which the LED mounts 110*a*, 100*b* lie or a horizontal plane in which the LEDs 108 lie. In fact, the vertex 164*a* protrudes not less than 50% of the way from the uppermost portion of the reflector 102 to the lowermost portion of the reflector 102.

The cross-sectional shape of the reflector 102 described above extends longitudinally in a direction perpendicular to the luminaire centerline 122 from a first longitudinal end of the reflector 168 to a second longitudinal end of the reflector 170 to form the inverted troughs. The shape of this cross-sectional curvature defines a first opening 168*a* at the first longitudinal end of the reflector 168 and a second opening 170*a* at the second longitudinal end of the reflector 170.

The first inside end cap 114 is mounted to the reflector first longitudinal end 168 and the first outside end cap 116 is mounted against the first inside end cap 114. Similarly, the second inside end cap 118 is mounted to the reflector second longitudinal end 170 and the second outside end cap 120 is mounted against the second inside end cap 118. The first and second inside end caps 114, 118 are of substantially mirror configurations of one another and the first and second outside end caps 116, 120 are likewise of substantially mirror configurations of one another. The first inside end cap 114 comprises a traversing plate 172 that traverses across the width of the luminaire 100 from reflector outer edge 154 to reflector outer edge 154 and closes off the first end opening 168*a*. The first inside end cap further comprises first and second mounting brackets 174*a*, 174*b* extending from each longitudinal end of the traversing plate 172. The first and second mounting brackets 174*a*, 174*b* extend perpendicular to the traversing plate 172 inward along the reflector outer edge 154 for a short distance and have, either defined therein or mounted thereto, structure to receive mounting hardware such as screws, bolts, rivets, mounting clips or the like for mounting the luminaire 100 to the suspended grid of a drop ceiling, or the like. In the depicted embodiment, the first inside end cap 114 mounts to the reflector by use of tabs 176 and slots 178*a*. The first outer end cap 116 also comprises a traversing plate 180 which has slots 178*b* defined therein to align with the slots of the first inside end cap 114 so that the tabs 176 may pass through both sets of slots 178*a*, 178*b* and hold both the first inside end cap 114 and the second inside end cap 116 to the reflector first end 168.

In the depicted embodiment, the traversing plate 172 of the first inside end cap 114 is approximately rectangular and defines an upper edge 182*a* and a lower edge 182*b* running from end to end. A vertical channel 184 is defined in the traversing plate 172 of the first inside end cap 114 extending inward from the traversing plate 172 toward the reflector first end 168. A horizontal channel 186 is defined in the traversing plate 180 of the first outside end cap 116 extending outward from the traversing plate 180 away from the adjacent first inside end cap 114. The channels 184, 186 are depicted as approximately half-round, but can be of any shape suitable for their function (described below) and formed by any appropriate method. In one embodiment, the vertical channel 184 extends as far as 0.217 inches inward from the traversing plate 172 of the first inside end cap 114 and the horizontal channel 186 extends as far as 0.188 inches outward from the traversing plate 180 of the first outside end cap 116.

The first inside end cap 114 is mounted to the reflector first end 168 with the tabs 176 and slots 178*a* and the first outside end cap 116 is mounted to the first inside end cap 114 with slots 178*b* and tabs 176 such that the outside end cap traversing plate 180 is flush against the first inside end cap traversing plate 172. With the first inside and outside end caps 114, 116 flush in this manner, the inward projecting vertical channel 184 of the first inside end cap 114 defines a channel between the first inside and outside end caps 114, 116. Similarly, the outward projecting horizontal channel 186 of the first outside end cap 116 defines a channel between the first inside and outside end caps 114, 116. When the first end caps 114, 116 are assembled against the reflector in this manner, a portion of the first inside end cap traversing plate 172 covers the first end opening 168*a* defined by the first longitudinal end 168 of the reflector 102, as best depicted in FIGS. 1A and 2A.

The vertical channel 182 is located approximately midway along the length of the first inside end cap traversing plate 172 and is elongated, extending vertically from a lower end 184*a* adjacent to the traversing plate lower edge 182*b* upward slightly past half-way between the traversing plate lower edge 182*b* and upper edge 182*a* to a vertical channel upper end 184*b*. The vertical channel lower end 184*a* extends at least as low as the horizontal channel 186 so that the channels connect. The vertical channel upper end 184*b* defines a vertical channel aperture 184*c*. As best depicted in FIG. 2A, the vertical channel upper end 184*b* extends above the reflector 102 such that the vertical channel aperture 184*c* has access to the space above the reflector 102. Although not depicted, the reflector 102 may have a notch to accommodate the inwardly extending vertical channel 184 so that the traversing plate 172 of first inside end cap 114 abuts the reflector first longitudinal end 168. Similarly, the first inside end cap 114 defines horizontal channel apertures 186*a* adjacent to each end of the luminaire 144, 146. Each horizontal channel aperture 186*a* is preferably located adjacent to the LED mount base 124 of an adjacent LED mount 110*a*, 110*b*. Wiring to power the LEDs 108 can be run from the end of a PCB on which the LEDs 108 are mounted, through the horizontal channel apertures 186*a*, along the horizontal channel 186, into the vertical channel 184 at the vertical channel lower end 184*a* and up the vertical channel 184 and through the vertical channel aperture 184*c* into the space above the reflector 102. Because the LEDs 108 are hidden from view, the wiring connecting to the LEDs 108 is also hidden from view and stays hidden from view through the horizontal and vertical channels 186, 184. Once the wiring reaches the space above the reflector 102, it may be connected to the driver 106. The driver 106 is connected to a power supply through the access plate on the top of the luminaire 100. In this configuration, all wiring to power the LEDs 108 is hidden from view. Alternative embodiments of the channels 184, 186 are contemplated. For example, the horizontal channel could be above the reflector and a vertical channel could be located at each end of the reflector, one each dropping down to an aperture adjacent each strip of LEDs 108. Other variations to hide the wires are also contemplated.

As indicated above, the second inside end cap 118 comprises all of the features of the first inside end cap 114 in a mirror fashion and the second outside end cap 120 comprises all of the features of the first outside end cap 116 in a mirror fashion. Therefore, discussion of features of the second inside end cap 118 and the second outside end cap 120 will not be repeated and all features thereof will be designated in the figures with the reference numbers of the corresponding features in the first inside and outside end caps 118, 120 (e.g. the slots of the second inside and outside end caps 118, 120 will be designated 178*a*' and 178*b*' in the figures).

The face leg 152 of each side of the reflector 102 defines the lowermost extremity of the luminaire 100 and is visible from the target area to be lighted. The lip in combination with the first and second inside end cap lower edges 182*b*, 182*b*' define a light-passing aperture 188 through which light emitted from the LEDs 108 leave the luminaire 100. In the depicted embodiment, no lens covers the light-passing aperture 188. In an alternative embodiment, a lens may span the light-passing aperture 188.

The top plate 104 comprises a traversing plate 190 atop the reflector 102 and extending along the length of the reflector 102 and beyond to a first mounting flange 192*a* depending from the traversing plate 190 outside the first outer end cap 116 and, at the other end, to a second mounting flange 192*b* depending from the traversing plate 190 outside the second outer end cap 120. The first and second mounting flanges 192*a*, 192*b* are fixed to the first and second outside end caps 116, 120, respectively. In the depicted embodiment, the first and second mounting flanges define fixing apertures 194*a* located adjacent to corresponding fixing apertures 194*b* in the first and second inner and outer end caps 114, 116, 118, 120. Screws or the like through the fixing apertures 194*a*, 194*b* secure the top plate 104 to the luminaire 100. The top plate traversing plate 190 extends laterally, symmetrically, on either side of the luminaire centerline 122 to a location adjacent to the reflector third reflecting leg 162. Optionally, first and second legs 196*a*, 196*b* depend from either side of the top plate traversing plate 190 to the reflector third reflecting leg 162 to help keep bugs, dirt, etc. away from the driver 106.

When the top plate 104 is mounted in this fashion, the top plate 104, reflector 102 and inner end caps 114, 118 define an enclosed space 198. The driver 106 is located in this enclosed space 198. When the access plate 112 is in place, the driver 106 is kept out of view and cannot be touched. The power can be routed from the driver 106 to the LEDs 108 through wires run through the vertical and horizontal channels 184, 186 as previously described. The vertical and horizontal channels 184, 186 and related apertures 184*c*, 186*a* need only be provided to one of the first inner and outer end caps 114, 116 or second inner and outer end caps 118, 120 since, at least in some embodiments, power need only be supplied to one end of the strip of LEDs 108. However, these channels 184, 186 and apertures 184*c*, 186*a* may be provided to both sets of end caps 114, 116, 118, 120 to increase manufacturing and assembly efficiencies by reducing the number of different parts.

The traversing plate 190 of the top plate 104 defines an access aperture 200 that is, in the depicted embodiment, rectangular in shape having a first end 200*a* adjacent to the first longitudinal end 168 of the reflector 102, an opposing second end 200*b*, and two lateral sides 200*c*, 200*d*. Other shapes are also acceptable. The access aperture 200 provides access to the enclosed space 198 and the wiring and driver 106 therein. Because the access aperture 200 is located on the top of the luminaire 100, it will not be visible, or accessible for tampering when the luminaire is installed in a drop ceiling or the like.

The access plate 112 comprises a body 202, depicted in the form of a plate, having a first end 202*a* for association with the access aperture first end 200*a* adjacent the first longitudinal end 168 of the reflector 102, an opposing second end 202*b* for association with the access aperture second end 200*b*, and two lateral sides 202*c*, 202*d* for association with the access aperture lateral sides 200*c*, 200*d*. The body 202 of the access plate 112 covers all, or substantially all, of the access aperture 200 to prevent unwanted access by humans and unwanted ingress of dirt, bugs and the like. Therefore, the shape of the body 202 approximates the shape, and size, of the access aperture 200. Where the access aperture 200 is rectangular in shape, as depicted, the body 202 is also of rectangular shape. As can be seen in FIG. 1B, the body 202 is slightly wider than the access aperture 200 such that the lateral sides 202*c*, 202*d* of the body 202 extend beyond the lateral sides 200*c*, 200*d* of the access aperture 200 over the traversing plate 190 of the top plate 104. The extra width prevents holds the access plate 112 above the top plate 104 and helps prevent ingress of dirt, bugs and the like.

A retaining plate 204 extends from the body second end 202*b*. The retaining plate 204 comprises a drop leg 204*a* extending downward from the body 202 and a catch leg 204*b* extending from the opposing end of the drop leg 204*a*. The downward drop of the drop leg 204*a* allows the catch leg 204*b* to extend underneath the top plate traversing plate 190 at the access aperture second end 200*b* while the body 202 sits above the traversing plate 190.

A locking flange 206 extends from the first end 202*a* of the body 202 of the access plate 112 toward the reflector first longitudinal end 168 beyond the access aperture second end 200*b* and ends with a U-shaped hook 206*a* having a first leg 206*b* extending upward to an upwardly oriented peak 206*c* and a second leg 206*d*, which is longer than the first leg 206*b* such that it extends downward beyond the locking flange. In the depicted embodiment, the first and second legs 206*b*, 206*d* are approximately perpendicular to the plate 202 of the access plate 112. The locking flange 206 is narrower than the access aperture 200 to facilitate one retaining prong 208 on either side of the locking flange 206. Each retaining prong 208 is comprised of a drop leg 208*a* extending downward from the body 202 and a catch leg 208*b* extending from the opposing end of the drop leg 208*a*. The downward drop of the drop leg 208*a* allows the catch leg 208*b* to extend underneath the top plate traversing plate 190 at the access aperture first end 200*a* while the body 202 sits above the traversing plate 190.

The distance between the distal end of the retaining plate catch leg 204*a* and the distal end of the retaining prong catch legs 208*a* is greater than the length of the access aperture 200 (i.e. the distance between the access aperture 200 first and second ends 200*a*, 200*b*). The access plate 112 is installed by (i) first tilting the catch leg 204*a* of the retaining plate downward and sliding that catch leg 204*a* under the access aperture 200 second end 200*b* at least until the distal ends of the catch legs 208*b* of the retaining prongs 208 can pass the access aperture 200 first end 200*a*, (ii) passing the retaining prongs 208 through the access aperture 200 until the lateral sides of the access plate body 202 contact the top plate 104, and (iii) sliding the access plate so that at least a portion of retaining prongs 208 slide under the top plate 104. After completion of these steps, the retaining plate catch leg 204*b* and the retaining prong catch legs 208*b* will hold the access plate 112 in the access aperture 200. In the depicted embodiment, the retaining plate catch leg 204*b* and the retaining prong catch legs 208*b* are shown as parallel to the access plate body 202. However, the distal end of one or both of them may be oriented upward so that they create a friction fit by biasing the access plate body 202 down against the top plate 104 when assembled.

The top plate 104 traversing plate 190 defines a slot 210 located adjacent to the access aperture first end 200*a* and extending approximately parallel to thereto. The slot 210 is sized and oriented to allow the second leg 206*d* of the U-shaped hook 206*a* to be inserted therein. Because the locking flange 206 extends in the same plane as the access plate body 202 and the U-shaped hook second leg 206*d* extends downward below that plane, that second leg 206*d* will deflect the locking flange 206 upward when the retaining plate 204 and retaining prongs 208 are under the top plate 104. The location of the slot 210 and the length of the locking flange 206 are defined such that the second leg 206*d* of the U-shaped hook 206*a* will slide into the slot 210 when the retaining plate 204 and retaining prongs 208 are properly located under the access plate body 202. The length of the second leg 206*d* is chosen so that the force required to flex the locking flange 206 sufficiently to remove the second leg 206*d* from the slot 210 is too great to occur accidentally during normal use and installation of the luminaire 100, but not so much that a human would experience any material challenge to pulling the U-shaped hook 206*a* and lifting the second leg 206*d* out of the slot 210 to facilitate removal of the access plate 112. Thus configured, installation of the access plate 112 can be concluded by sliding the access plate 112 toward the slot 210 until the second leg 206*d* of the U-shaped hook 206*a* snaps into the slot 210, preventing further sliding of the access plate 112 and thus securing the access plate 112 in the access aperture 200 until intentionally removed. The height of the first leg 206*b* is sufficient to allow a human to grasp with hands and/or tools, such as pliers or the like.

As seen in FIGS. 1B, 1C and 2A, the reflector 102 and the top plate 104 form the top of the luminaire 100 in the depicted embodiment. From lateral edges of the top plate to the reflector outermost edges 154, 156, a top surface 102*a* of the reflector is the uppermost portion of the luminaire 100 and is exposed to the surroundings of the luminaire 100. Further, between the top plate 104 and the last point of contact 142 between the reflector 103 and the LED mount 110, the reflector 102 is the only portion of the luminaire 100 between the target area to be lighted and whatever lies above the luminaire. The construction of the luminaire therefore 100 eliminates a housing above the reflector 102, thus reducing parts, materials, assembly time, weight and, as a result, cost.

With the access plate 112 providing easy access to the enclosed space 198 as described above, the enclosed space 198 is an ideal location for the driver 106. The driver can rest atop the reflector 102, can be secured to the underside of the top plate 104 or can be secured to the underside of the access plate 112. By securing the driver 106 to the underside of the access plate 112, the driver can be secured out of sight and away from accidental damage, yet be readily accessible for installation, replacement, etc. by the simple act of flexing the locking flange 206 to remove the second leg 206*d* of the U-shaped hook 206*a* from the slot 210, sliding the access plate 112 backwards until the retaining prongs 208 clear the access aperture 200 and then remove the access plate 112 from the access aperture 200. By providing access to the enclosed space 198 from the back of the luminaire 100 via the access aperture 200 and access plate 112, the reflector 102 need not be disturbed to gain access to the driver from the front side of the luminaire 100. Prior to the instant disclosure, conventional thinking was to provide an access panel to the driver going through the accessible side. As can be best seen in FIGS. 1A, 1C and 2A, once the luminaire 100 is installed in a drop ceiling or the like, nearly all portions of the luminaire 100 accessible to a repairman, etc. will be the reflector 102. However, such an access panel would create seams, gaps, ridges and/or ajar access panels that disrupt the light distribution sought to be created by the reflector 102. By locating the access plate 112 on the back of the luminaire 100, any such disruption is avoided.

The LED mounts 110*a*, 110*b* are held in the luminaire 100 by the upper and lower LED mount grasping legs 148, 150 creating a force fit upon the LED mount lower leg 126 to hold the LED mounts 110*a*, 110*b* in place. Alternatively, or by supplement, the LED mounts 110*a*, 110*b* may be fixed to the reflector in other manners such as by welding, screw, bolt, rivet, adhesive or the like. However, because the lower LED mount grasping leg 150 is visible from the target area to be lighted by the luminaire, aesthetic considerations might dictate otherwise. Alternatively, or by supplement, the upper leg distal portion 134 of the LED mount 110*a*, 110*b* can be mounted to the reflector first reflecting leg 158 such as by welding, screw, bolt, rivet, adhesive or the like. Angles A and B of the LED mounts 110*a*, 110*b*, in combination with the contour of the reflector 102, as discussed above, controls the light emitted from the LEDs 108 and thus controls the light distribution passing through the light-passing aperture 188 defined by the luminaire 100.

The angle between the LED mount base 124 and the plane defined by the light-passing aperture 188 also impacts this light distribution because it controls the angles at which light leaving the LED mount 110*a*, 110*b* impact the reflector 102. In the depicted embodiment, the lower LED mount grasping leg 150, and thus the LED mount lower leg, is 22° above the plane defined by the light-passing aperture 188. This angle can be adjusted by changing (i) the angle between the lower LED mount grasping leg 150 and the face leg first portion 152*a*, and/or (ii) angle A between the LED mount base 124 and the LED mount lower leg 126.

In an alternative embodiment, the LED mount 110*a*, 110*b* is not grasped by the reflector 102 at the light-passing aperture 188. Instead, each LED mount 110*a*, 110*b* is secured to the reflector 102 only at, for example, the LED mount upper leg 130 as previously discussed and angle C is adjusted. In yet another alternative embodiment, the reflector LED mount portion 136 diverges inward to form an LED mount base to receive the LEDs 108, taking on the function of the LED mount 110*a*, 110*b* in the depicted embodiment.

While the disclosure makes reference to the details of preferred embodiments of the disclosure, it is to be understood that the disclosure is intended in an illustrative rather than in a limiting sense, as it is contemplated that modifications will readily occur to those skilled in the art, within the spirit of the disclosure and the scope of the appended claims.

We claim:

1. A luminaire comprising:

a reflector dividing the luminaire into a top side and a bottom side, the reflector having a top surface adjacent the luminaire top side and a bottom surface adjacent the bottom side, the reflector further having first and second opposing ends;

a light source located on the luminaire bottom side;

a driver located on the luminaire top side for delivering power to the light source;

an inner end cap located at the first end of the reflector;

an outer end cap associated with the inner end cap, the inner and outer end caps defining a channel therebetween;

wiring run from the driver through the channel to the light source.

2. The luminaire of claim 1, wherein the inner end cap and outer end cap are contiguous.

3. The luminaire of claim 1, wherein the channel is defined by a depression formed in one of the inner end cap and outer end cap.

4. The luminaire of claim 1, wherein the channel is defined by a depression formed in each of the inner end cap and outer end cap.

5. The luminaire of claim 1, the channel comprises a vertically oriented channel and a horizontally oriented channel.

6. The luminaire of claim 1, the reflector defining two inverted troughs, each having an inner side and an outer side, the inner sides of the inverted troughs meeting at a vertical centerline of the luminaire and defining a downwardly depending peak and the driver being located in the luminaire top side of the downwardly depending peak;

the inner end cap closing off a first end of the inverted troughs;

the light source located at the outer side of one of the inverted troughs; and the channel extending from the luminaire top side of the downwardly depending peak to a position adjacent to the light source.

7. A luminaire comprising:

a reflector defining two inverted troughs, each having an inner side and an outer side, the inner sides of the inverted troughs meeting at a vertical centerline of the luminaire and defining a downwardly depending peak;

the inverted troughs jointly defining a downwardly open recess of the luminaire;

a first end cap closing off a first end of the inverted troughs and a second end cap closing off a second end of the inverted troughs, wherein the second end of the inverted troughs is opposite the first end of the inverted troughs;

a light source comprising one or more LEDs located at the outer side of each inverted trough and facing inward and upward at an angle from horizontal to emit light into the downwardly open recess; and a lip extending inward and upward from adjacent to each light source to a distal end;

each light source comprising one or more LEDs located on an LED mount comprising an LED mount base and a lower leg, the lip comprising a lower grasping leg extending from the reflector and an upper grasping leg extending from the lower grasping leg, and the LED mount base lower leg is held between the upper and lower grasping legs.

8. The luminaire of 7, the lip distal end lying in a horizontal plane encompassing the light sources.

9. The luminaire of 7, wherein the lip is an integral extension of the reflector.

10. The luminaire of 7, the downwardly depending peak defines a V-shaped protrusion culminating in a vertex.

11. The luminaire of 7, the reflector being symmetrical about the vertical luminaire centerline.

12. The luminaire of 7, further comprising a top plate extending from the top surface of one inverted trough to the other inverted trough, covering the top surface of the downwardly depending peak to create an enclosed space.

13. The luminaire of 7, each reflector trough defining a straight first reflecting leg, a second straight reflecting leg extending at an angle to the first reflecting leg, a curved third reflecting leg extending from the second reflecting leg and a fourth reflecting leg extending from the third reflecting leg; the fourth reflecting legs of the two reflector troughs meeting at the luminaire vertical centerline.

14. A luminaire comprising:

a reflector defining two inverted troughs, each having an inner side and an outer side, the inner sides of the inverted troughs meeting at a vertical centerline of the luminaire and defining a downwardly depending peak;

the inverted troughs jointly defining a downwardly open recess of the luminaire;

a first end cap closing off a first end of the inverted troughs and a second end cap closing off a second end of the inverted troughs, wherein the second end of the inverted troughs is opposite the first end of the inverted troughs;

a light source comprising one or more LEDs located at the outer side of each inverted trough and facing inward and upward at an angle from horizontal to emit light into the downwardly open recess; and a lip extending inward and upward from adjacent to each light source to a distal end;

the first and second end caps and the lip collectively defining a light aperture, and the light source located so that light emitted from the light source passes through the light aperture, the light aperture defining a horizontal plane that encompasses the downwardly depending peak.

15. A luminaire comprising:

a reflector having first and second outer edges and defining a downwardly open recess;

the reflector defining a downwardly depending peak dividing the downwardly open recess into two troughs;

a light source comprising one or more LEDs located at each of the first and second outer edges and configured to emit light into the downwardly open recess and the one or more LEDs facing inward and upward at an angle from horizontal; and a lip extending inward and upward from adjacent to each light source to a distal end; the lips collectively defining a light aperture; the light aperture defining a horizontal plane the horizontal plane encompassing the downwardly depending peak.

16. The luminaire of claim 15 further comprising a first end cap closing off a first end of the inverted troughs and a second end cap closing off a second end of the inverted troughs, wherein the second end of the inverted troughs is opposite the first end of the inverted troughs.

17. The luminaire of 16, further comprising a lip extending inward and upward from adjacent to the light source to a distal end, the first and second end caps and the lip collectively defining a light aperture, and the light source located so that light emitted from the light source passes through the light aperture, the light aperture defining a horizontal plane.

18. The luminaire of claim 15 wherein the downwardly depending peak culminates in a vertex located at a vertical centerline of the luminaire.

19. The luminaire of claim 15, the lip distal end lying in a horizontal plane encompassing the light sources.

20. The luminaire of 15, the downwardly depending peak defining a V-shaped protrusion culminating in a vertex.

* * * * *